US012089799B2

(12) United States Patent
Xing et al.

(10) Patent No.: US 12,089,799 B2
(45) Date of Patent: Sep. 17, 2024

(54) ROLLER BRUSH, FLOOR BRUSH OF VACUUM CLEANER, AND VACUUM CLEANER

(71) Applicant: Suzhou Rongxuan Electric Co., Ltd, Suzhou (CN)

(72) Inventors: Tianbo Xing, Suzhou (CN); Jundong Xing, Suzhou (CN)

(73) Assignee: Suzhou Rongxuan Electric Co., Ltd, Suzhou (CN)

( * ) Notice: Subject to any disclaimer, the term of this patent is extended or adjusted under 35 U.S.C. 154(b) by 0 days.

(21) Appl. No.: 18/584,011

(22) Filed: Feb. 22, 2024

(65) Prior Publication Data

US 2024/0260801 A1 Aug. 8, 2024

(30) Foreign Application Priority Data

Nov. 29, 2023 (CN) ..... 202311604995.8

(51) Int. Cl.

| | |
|---|---|
| ***A47L 9/04*** | (2006.01) |
| ***A46B 9/08*** | (2006.01) |
| ***A46B 13/00*** | (2006.01) |
| ***A47L 11/18*** | (2006.01) |
| ***A47L 11/40*** | (2006.01) |

(52) U.S. Cl.

CPC ..... *A47L 9/0477* (2013.01); *A46B 9/08* (2013.01); *A46B 13/001* (2013.01); *A47L 11/18* (2013.01); *A47L 11/4041* (2013.01); *A46B 2200/30* (2013.01)

(58) Field of Classification Search

CPC .... A47L 9/0477; A47L 11/18; A47L 11/4041; A46B 9/08; A46B 13/001; A46B 2200/30

See application file for complete search history.

(56) References Cited

U.S. PATENT DOCUMENTS

| | | | |
|---|---|---|---|
| 2011/0023263 A1 | 2/2011 | Boyes | |
| 2014/0137367 A1 | 5/2014 | Li et al. | |
| 2023/0210250 A1 | 7/2023 | Xing et al. | |

FOREIGN PATENT DOCUMENTS

| | | | | |
|---|---|---|---|---|
| CN | 107981780 A | * | 5/2018 | ..... A47L 9/04 |
| CN | 113001893 A | * | 6/2021 | ..... B29C 45/40 |
| WO | WO2019026307 | * | 2/2019 | ..... A47L 9/04 |

OTHER PUBLICATIONS

CNIPA, Notification to grant patent right for Chinese application CN202311604995.8, Jan. 4, 2024.

* cited by examiner

*Primary Examiner* — David Redding
(74) *Attorney, Agent, or Firm* — Zhigang Ma

(57) ABSTRACT

Disclosed are a roller brush, a floor brush, and a vacuum cleaner. The roller brush of the present disclosure includes a base body, wherein the axial center line of the base body is a, the outer surface of the base body is provided with at least one group of cyclonic grooves, each group of cyclonic grooves includes at least one first groove, the surface of a cylinder passing through a first position and taking a as the axial center line is taken as A, and the surface of a cylinder passing through a second position and taking a as the axial center line is taken as B, and the distance D between A and B in a radial direction perpendicular to a is greater than 2 mm. According to the roller brush of the disclosure, the problem of the hair entangled around the roller brush is effectively solved.

20 Claims, 17 Drawing Sheets

ROLLER BRUSH, FLOOR BRUSH OF VACUUM CLEANER, AND VACUUM CLEANER

TECHNICAL FIELD

The present disclosure relates to the technical field of vacuum cleaners, in particular to a roller brush, a floor brush of a vacuum cleaner, and a vacuum cleaner.

BACKGROUND

The entanglement of hair with vacuum cleaners has always been the biggest headache for the industry and consumers. This is mainly because in the suction process, with the cleaning rotation of the roller brush of the vacuum cleaner, hair and the like are easily entangled around the surface of the roller brush. In a more serious situation, hair will be entangled around the drive shaft of the motor, causing the hair to be entangled and get stuck in the motor to burn the motor.

At present, there is a way to cut the entangled hair into sections and then suck the hair sections by arranging a hair cutting blade on the vacuum cleaner, but this increases the cost of the vacuum cleaner, and makes the structure of the roller brush of the vacuum cleaner complicated and there is a risk of hurting fingers.

Therefore, how to fundamentally solve the hair entanglement on the vacuum cleaner remains an important issue that urgently needs to be solved in the vacuum cleaner industry.

SUMMARY

In order to solve the above technical problem, the present disclosure provides a roller brush, including a base body, wherein the axial center line of the base body is a, the outer surface of the base body is provided with at least one group of cyclonic grooves, each group of cyclonic grooves includes: at least one first groove, the inner groove wall on the side of the first groove away from the axial center line a is a large-diameter groove wall, and the inner groove wall on the side of the first groove closer to the axial center line a is a small-diameter groove wall, the edge of the large-diameter groove wall away from a is a first edge, and at least partial region of the first edge overlaps with the surface of at least one cylinder taking a as the axial center line, with the overlapping region being a first position; at least partial region of the small-diameter groove wall in the length direction of a overlaps with the surface of the cylinder taking a as the axial center line, with the overlapping region being a second position; the surface of the cylinder passing through the first position and taking a as the axial center line is taken as A, the surface of the cylinder passing through the second position and taking a as the axial center line is taken as B, and the distance D between A and B in the direction perpendicular to the axial center line a and in the radial direction of the base body is greater than 2 mm.

The roller brush of the present disclosure has the following beneficial effects: according to the present disclosure, the size of D of the first groove is set to be greater than 2 mm, because D is set to be large, the air flow entering the first groove forms a large cyclone under the action of the first groove, and guided by the inner groove wall of the first groove, the air flow blown toward the cyclonic groove under the action of a suction force of the vacuum cleaner is swirled due to being hindered by the first groove, and is blown outward in a direction away from the base body of the roller brush, thereby causing the hair to be blown outward in a direction away from the roller brush, so that the probability of hair or the like getting close to the base body of the roller brush is effectively reduced, the contact of the hair and the like with the outer surface of the roller brush is minimized, and further, the hair and the like are directly sucked away in a cavity of a vacuum cleaner head, thus directly and fundamentally eliminating the possibility of hair entangled on the roller brush and effectively solving the problem of hair entangled on the roller brush.

Further, at least partial region of the first edge is a straight line, and at least partial region of the first position is a straight line.

Further, at least partial region of the first edge is a straight line, a curved line, a wavy line or a broken line.

Further, each group of cyclonic grooves includes two first grooves arranged in sequence in a circumferential direction of the base body, and the two first grooves are oppositely or sequentially arranged on a surface of the base body. Therefore, the air flow forms cyclones at the two first grooves under the guidance of the two first grooves, and is swirled and blown out in the direction far away from the outer surface of the base body, so that the first groove plays a role in whirling pressurization, which makes the air flow pressure greater, and the cyclones formed by the air flow in the two first grooves realize the air flow whirling under the guidance of the first grooves, and are rotationally blown out in the direction far away from the outer surface of the base body, respectively, and the air flows respectively swirled and blown out through the two first grooves produce a merging effect. For wind forces in the circumferential direction of the base body, the two first grooves cancel each other out; wind forces blowing outward in a direction away from the base body are guided by the rotation of the two first grooves so as to have a merging effect. Therefore, the hair has no chance to be entangled on the surface of the base body, and is blown to be in a "suspended state" near the surface of the base body under the action of the guiding wind passing through the two first grooves, and then the hair in the "suspended state" is smoothly sucked into the suction port of the vacuum cleaner during the rotation of the roller brush, so that a cyclone action resultant force is formed on the hair in the direction away from the surface of the roller brush under the action of the two cyclonic grooves. Therefore, the hair is blown away in the direction away from the surface of the base body, so that a higher cyclone force can be formed at a lower energy consumption of the vacuum cleaner, and the hair is in a state similar to "floating" on the outer surface of the roller brush, thus fundamentally solving the problem that the hair is entangled on the roller brush.

Further, the two first grooves in each group of cyclonic grooves are arranged in mirror images. Thus, under the common guiding action of the two first grooves, a resultant force point of action force is formed in the regions of the two first grooves which are close to each other and located on the outer surface of the base body of the roller brush, and a greater force is formed to blow hair and the like away from the surface of the roller brush. Accordingly, the power consumption of the vacuum cleaner can also be reduced at the same size.

Further, the mutually adjacent regions of the two first grooves protrude toward the direction away from the axial center of the roller brush. In some embodiments, protruding toward the center can refer to the prominent effect formed by the structure of the circumferential arch-shaped arc surface of the base body of the roller brush; it is also possible to form a structure that is larger than the diameter of the basic structure part of the base body at the middle connection position of the two first grooves 1, that is, protruding in the direction away from the central axis. As a result, under the guiding of the protruding structure, it is possible to reduce the resistance at the time of merging the air flows guided by the two first grooves in a swirl manner, and to smoothly merge the two air flows.

Furthermore, the two first grooves are not uniform in size, and the Ds are not equal. Thus, under the guiding of the two first grooves, a similar effect can still be exerted as with the two first grooves in mirror-image arrangement. At the same time, the resultant force point of the air flows formed by the two first grooves can be adjusted to be no longer outside the intermediate regions of the two first grooves, thus meeting the more diversified structure and use requirements of the vacuum cleaner in actual vacuum suction process.

Further, the mutually distant inner side walls of the two first grooves extend toward the direction away from the axial center line of the base body. Thus, the air flow can be guided by the structural guiding of the first groove, and the air flow is guided by the first groove and blown out toward the direction away from the base body, thereby achieving the effect of blowing hair or the like out toward the direction away from the base body.

Further, each group of cyclonic grooves includes one first groove, and further includes one second groove, wherein the second groove has a groove depth of not exceeding 2 mm, and the second groove is opposite to the first groove.

Still further, the second groove is arranged on the outer surface of the base body.

Still further, the roller brush further includes a connector connected to the outer surface of the base body, wherein the second groove is arranged on the connector.

Further, the shape of a cross section of at least partial region of the first groove is at least one of a U shape, a C shape, a V shape, an arc shape, an L shape, a semicircle shape, and a right-angle shape, and when the first groove is V-shaped, an opening angle $\alpha$ of the first groove does not exceed 123 degrees.

Further, a shape of a cross section of the second groove is at least one of a U shape, a C shape, a V shape, an arc shape, a semicircle shape, and a right-angle shape, and when the second groove is V-shaped, an opening angle $\alpha$ of the second groove does not exceed 123 degrees.

Further, the first groove is arranged on the outer surface of the base body in a spiral shape, a V shape or a straight line shape.

Further, when the first groove is arranged in a straight line, the first groove is arranged in a direction parallel to or at a spaced angle to the axial center line of the base body.

Further, mutually distant inner side walls of the two second grooves extend toward the direction away from the axial center line of the base body.

The present disclosure provides a floor brush of vacuum cleaner, including the aforementioned roller brush.

The present disclosure provides a vacuum cleaner, including the floor brush of a vacuum cleaner as previously described.

BRIEF DESCRIPTION OF FIGURES

FIG. 2 (*b*) is a schematic side view of a roller brush according to an embodiment of the present disclosure;

FIG. 4 is a structural schematic diagram of a roller brush according to the present disclosure in which the first edge is straight and not parallel to a;

FIG. 5 (*b*) is a schematic side view of two grooves in a non-mirror image configuration;

FIG. 7 (*b*) is a structural schematic diagram of forming a groove bottom on a connector;

FIG. 8 (*b*) is a three-dimensional structural schematic diagram of another embodiment in which a cyclonic groove in a V-shaped configuration;

FIG. 9 (*b*) is a three-dimensional structural schematic diagram of another embodiment in which a cyclonic groove in a spiral-shaped configuration;

in the figures:

1, base body; a, axial center line; 2, cyclonic groove; 21, first groove; 211, large-diameter groove wall; 212, small-diameter groove wall; 213, first edge; 214, first position; 215, second position; 22, second groove; 23, protruding portion; 24, intermediate portion; 251, first air flow; 252, second air flow; 253, third air flow; 254, fourth air flow; 255, fifth air flow; 25, fixing rib; 26, air flow; F, resultant force point; 27, ramp surface; 3, vacuum cleaner head; 31, cavity; 32, suction port.

DETAILED DESCRIPTION

The following detailed description of the preferred embodiments of the present disclosure will be made with reference to the accompanying drawings so that the advantages and features of the present disclosure can be more readily understood by those skilled in the art, and thus the scope of the present disclosure will be more clearly and clearly defined.

Entangling hair with vacuum cleaners is the most headache to industry and consumers. At present, the cleaning and treatment of hair by vacuum cleaners has not been effectively solved, and tools such as blades, hooks or comb teeth need to be equipped to treat the hair entangled around the roller brush.

Figure 1:
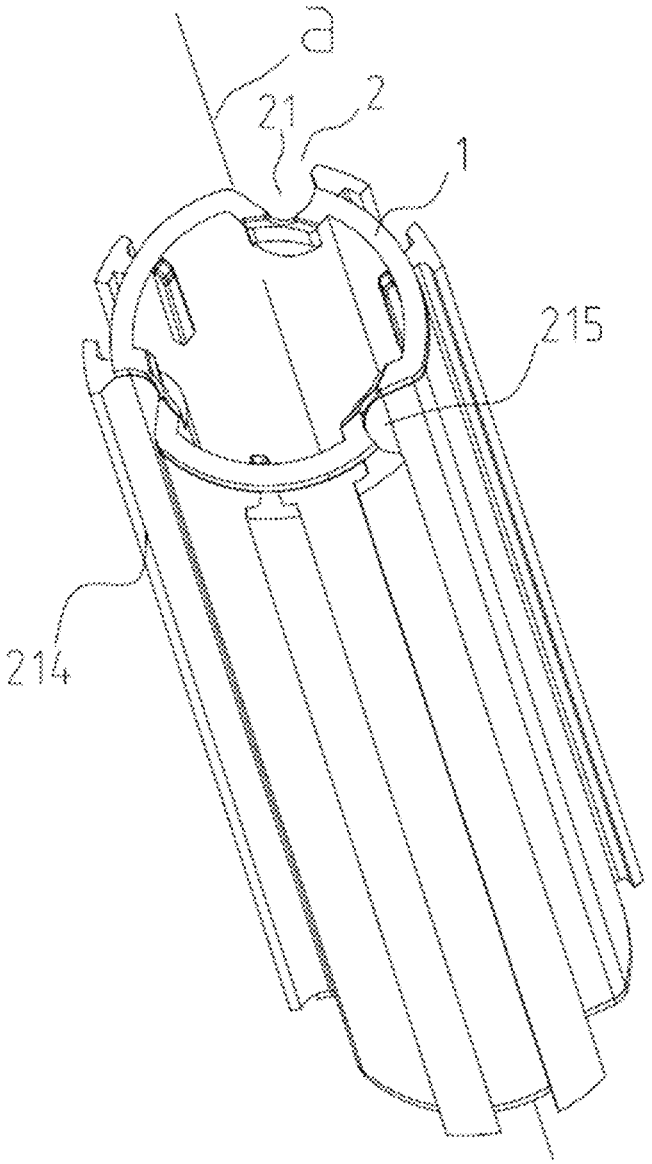
FIG. 1 is a three-dimensional structural schematic diagram of an embodiment of the present disclosure.
Figure 2:
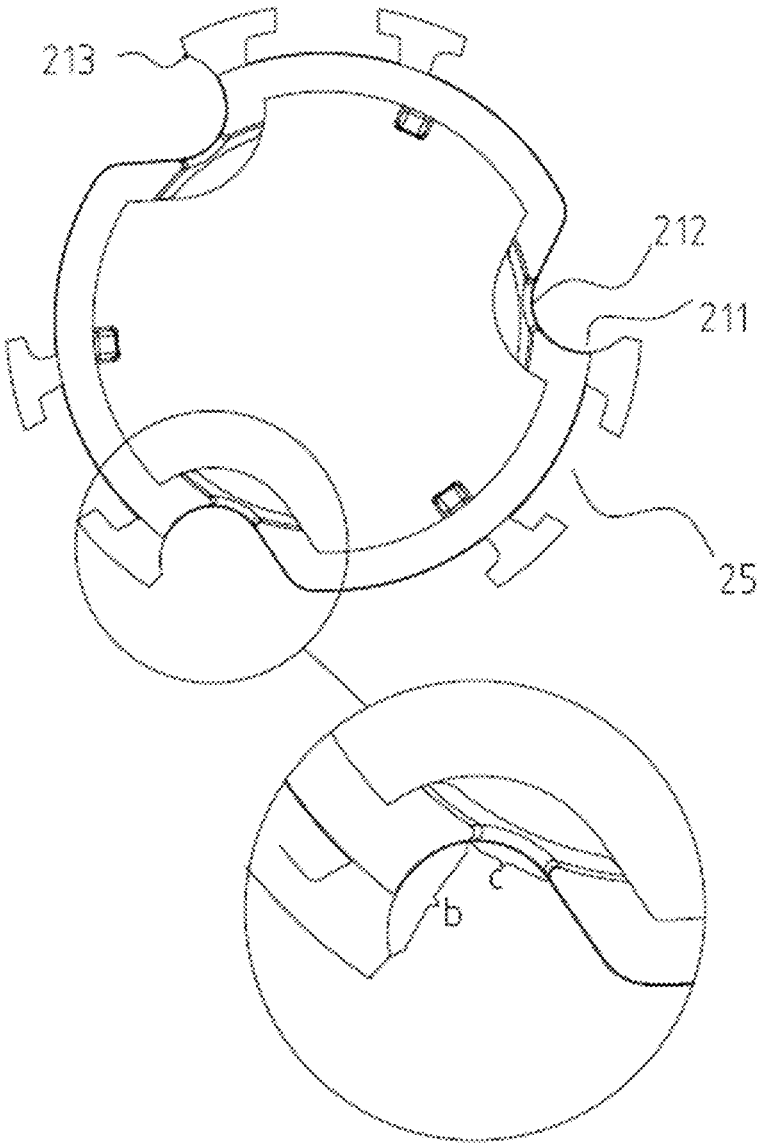
FIG. 2 (*a*) is a schematic side view of a roller brush according to an embodiment of the present disclosure.
Figure 2:
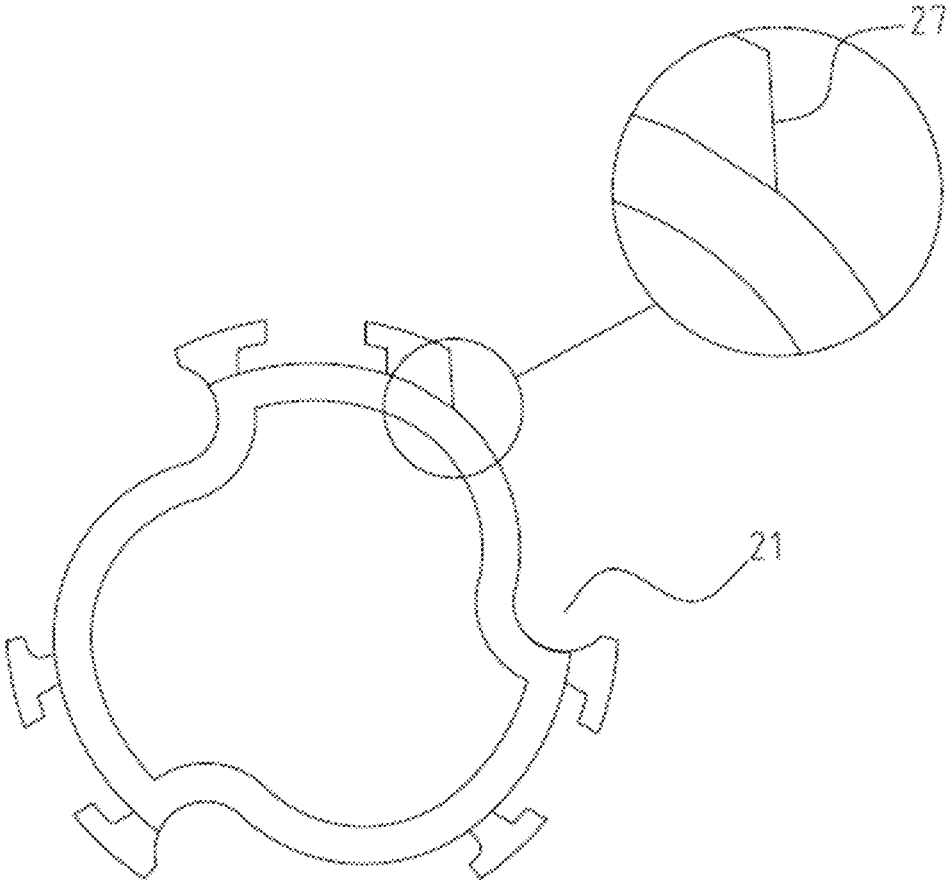
Figure 3:
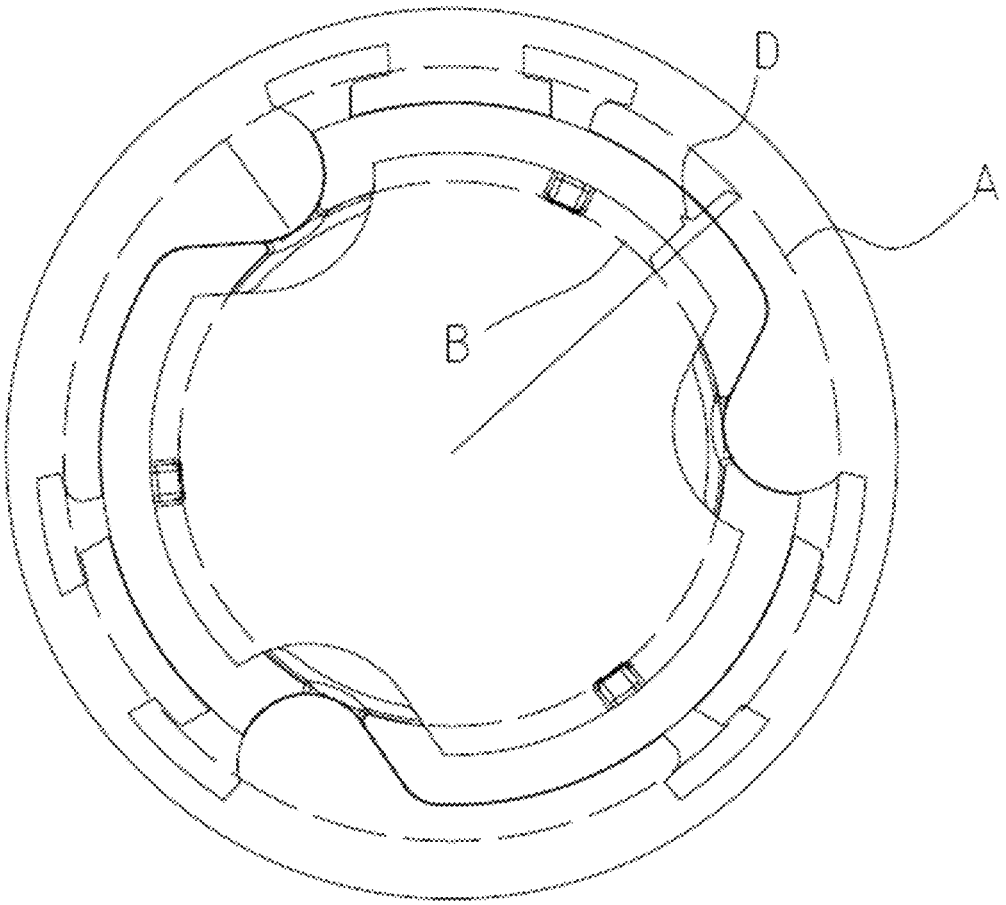
FIG. 3 is a schematic diagram of a reference state when cylinder surfaces A and B are added with auxiliary lines.

In order to solve the above technical problems, the present disclosure provides a roller brush, as shown in FIG. 1, which includes a base body 1, wherein the axial center line of the base body 1 is a, the outer surface of the base body 1 is provided with at least one group of cyclonic grooves 2, and each group of cyclonic grooves 2 includes: at least one first groove 21. Referring to FIG. 2 (*a*), the inner groove wall on the side of the first groove 21 away from the axial center line a is a large-diameter groove wall 211, and the inner groove wall on the side of the first groove 21 closer to the axial center line a is a small-diameter groove wall 212. The edge of the large-diameter groove wall 211 away from a is a first edge 213, and at least partial region of the first edge 213 overlaps with the surface of at least one cylinder taking a as the axial center line, with the overlapping region being a first position 214 (shown in conjunction with FIG. 1); at least partial region of the small-diameter groove wall 212 in the length direction of a overlaps with the surface of the cylinder taking a as the axial center line, with the overlapping region being a second position 215 (shown in conjunction with FIG. 1); referring to FIG. 3, the surface of the cylinder passing through the first position 214 and taking a as the axial center line is taken as A, the surface of the cylinder passing through the second position 215 and taking a as the axial center line is taken as B, when the second position 215 is located closest to the axial center line a, the distance between A and B is D in the direction perpendicular to the axial center line a and in the radial direction of the base body 1, and D in the present disclosure is greater than 2 mm. For example, in some embodiments, D is 2.1 mm; in some embodiments, D is 3 mm; in some embodiments D is 3.5 mm; in some embodiments, D is 4.2 mm; in some embodiments D is 7.8 mm; in some embodiments, D is 9.2 mm, and in other possible embodiments, D may be other dimensions.

Figure 12:
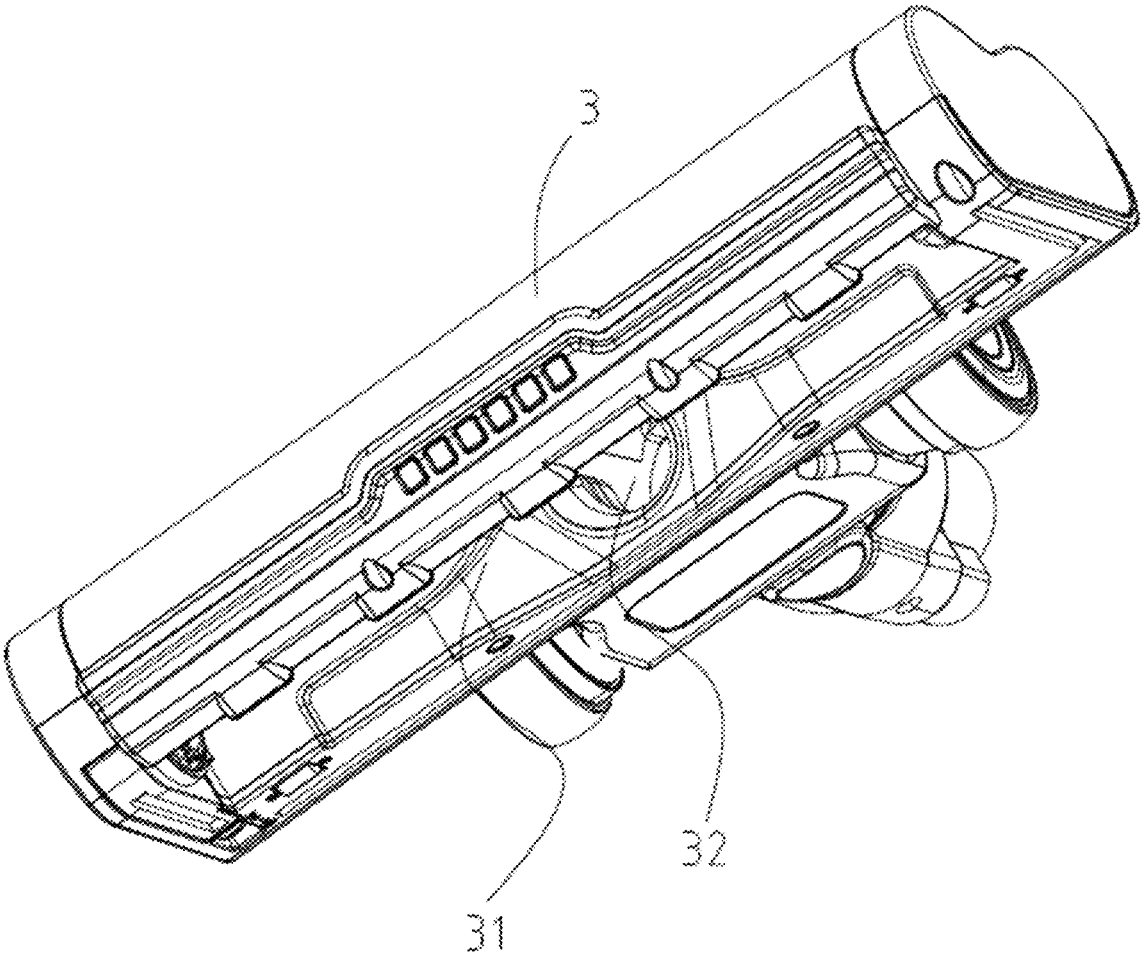
FIG. 12 is a structural schematic diagram of a vacuum cleaner head to which the roller brush of the present disclosure is applied.

According to the present disclosure, the cyclonic groove 2 is arranged on the outer surface of the base body 1 of the roller brush, and the parameter D of the cyclonic groove 2 is set to be greater than 2 mm, thus when the roller brush rotates, with the continuous vacuumizing force of the vacuum cleaner, the hair on the ground (such as carpet or floor) collides with the outer surface of the roller brush with the suction force. When the hair collides with the first groove 21, since the parameter D of the cyclonic groove 2 of the first groove 21 is set to be greater than 2 mm, the hair can move away from the outer surface of the base body 1 under the action of the first groove 21. Because D is set to be large, the air flow entering the first groove 21 forms a large cyclone under the action of the first groove 21, and guided by the inner groove wall of the first groove 21, the air flow blown toward the cyclonic groove 2 under the action of a suction force of the vacuum cleaner is swirled due to being hindered by the first groove 21, and is blown outward in a direction away from the base body 1 of the roller brush, thereby causing the hair to be blown outward in a direction away from the roller brush, so that the probability of hair or the like getting close to the base body 1 of the roller brush is effectively reduced, the hair and the like are no longer attached or entangled to the outer surface of the roller brush as in a conventional cleaner, the contact of the hair and the like with the outer surface of the roller brush is minimized, and further, the hair and the like are sucked into a cavity 32 of a vacuum cleaner head 3 (as shown in FIG. 12) and then directly sucked away through suction port 32, thus directly and fundamentally eliminating the possibility of hair entangled on the roller brush and effectively solving the problem of hair entangled on the roller brush.

In some embodiments, "large-diameter groove wall 211" in the present disclosure refers to region b as shown in FIG. 2 (*a*), and "small-diameter groove wall 212" refers to region c as shown in FIG. 2 (*a*); the large-diameter groove wall 211 is connected to the small-diameter groove wall 212, and the large-diameter groove wall 211 is located on the side of the small-diameter groove wall 212 away from the axial center line a. Obviously, the large-diameter groove wall 211 and the small-diameter groove wall 212 are not limited to the region b or the region c selected by the braces in FIG. 2 (*a*), but only to ensure that the small-diameter groove wall 212 is closer to the axial center line a than the large-diameter groove wall 211.

In some embodiments, the first groove 21 is formed on the outer surface of the roller brush by recessing the outer surface of the roller brush inward (in a direction closer to the axial center).

In some embodiments, the first edge 213 is separated from the outer side surface of the roller brush. This is to make better use of the original structural form of the roller brush. For example, at present, scraping strips or brushes are mostly arranged on the surface of the roller brush, so it is necessary to correspondingly arrange fixing ribs 25 on the outer surface of the roller brush. Therefore, the first groove 21 can be formed by the cooperation of the structure of the fixing rib 25 and the groove-shaped structure on the outer surface of the roller brush.

In other possible embodiments, the first edge 213 may also be integrated with the outer side surface of the roller brush. Alternatively, the fixing rib 25 may be integrally formed on the outer surface of the roller brush, or may directly form the first groove 21 by recessing the outer surface of the roller brush. Therefore, the overall structure of the roller brush is easy to process and shape; if it is necessary to set the fixing rib, the fixing rib can also be formed in one step, which enables the fixing rib and the first groove to be formed at the same time without the need to separately process the first groove 21.

In some embodiments of the present disclosure, as shown in FIG. 1, the first edge 213 is a straight line, the first position 214 is a consecutive straight line, and the line where the first position 214 is located is parallel to a.

Figure 4:
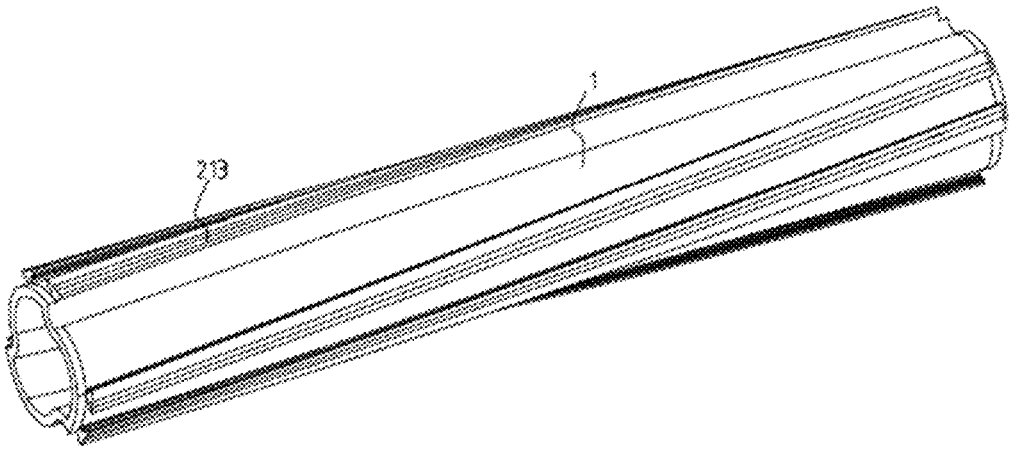

In some embodiments of the present disclosure, as shown in FIG. 4, the first edge 213 is a straight line, but is not parallel to a. Therefore, the first edge 213 can overlap with a plurality of cylinders with different diameters and taking a as the axial center line. In other words, the first edge 213 passes through the cylinders with different diameters and taking a as the axial center line obliquely in turn, and the overlapping position of the first edge 213 and each cylinder is point overlapping.

Figure 5:
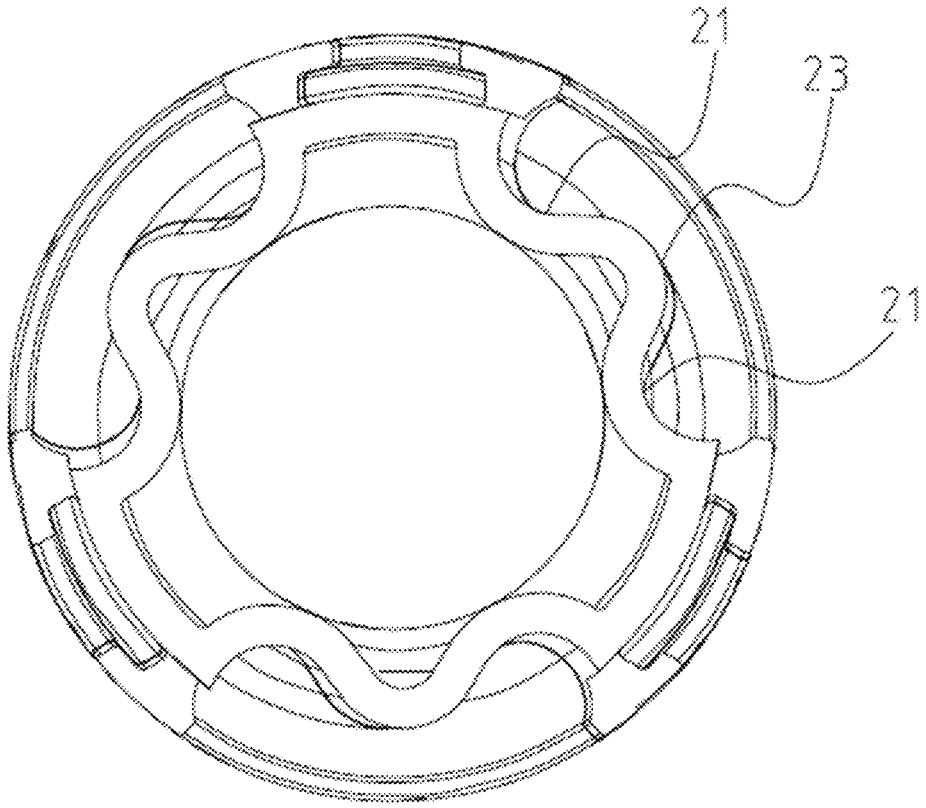
FIG. 5 (*a*) is a schematic side view of two grooves in a mirror image configuration.
Figure 5:
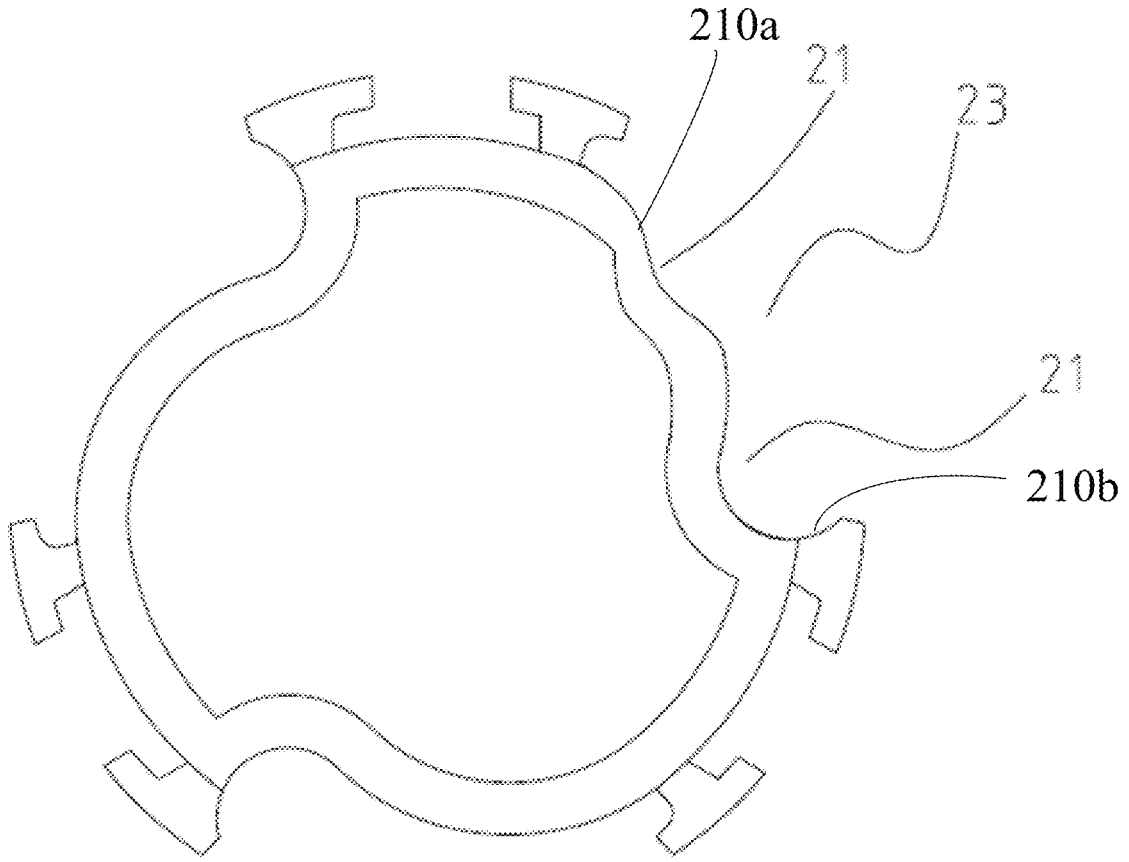

Referring to FIG. 5 (*a*), in some embodiments of the present disclosure, each group of cyclonic grooves 2 includes two first grooves 21 arranged in the circumferential direction of the base body 1, and the two first grooves 21 in each group of cyclonic grooves 2 are oppositely or sequentially arranged on the surface of the base body 1. As used herein, "two first grooves 21 being opposite to each other" means that the large-diameter groove walls 211 of the two first grooves 21 are located away from each other, the connection region of the two first grooves 21 is the outer surface of the base body 1, the large-diameter groove walls 211 of the two first grooves 21 are in a mutually distant positional relationship, and the length direction of the two first grooves 21 is in the length direction of the base body 1. Therefore, the air flow forms cyclones at the two first grooves 21 under the guidance of the two first grooves 21, and is swirled and blown out in the direction far away from the outer surface of the base body 1, so that the first groove 21 plays a role in whirling pressurization, which makes the air flow pressure greater, and the cyclones formed by the air flow in the two first grooves 21 realize the air flow whirling under the guidance of the first grooves 21 (see FIG. 6), and are rotationally blown out in the direction far away from the outer surface of the base body 1, respectively, and the air flows respectively swirled and blown out through the two first grooves 21 produce a merging effect. For wind forces in the circumferential direction of the base body 1, the two first grooves 21 cancel each other out; wind forces blowing outward in a direction away from the base body 1 are guided by the rotation of the two first grooves 21 so as to have a merging effect. Therefore, the hair has no chance to be entangled on the surface of the base body 1, and is blown to be in a "suspended state" near the surface of the base body 1 under the action of the guiding wind passing through the two first grooves 21, and then the hair in the "suspended state" is smoothly sucked into the suction port of the vacuum cleaner during the rotation of the roller brush, so that a cyclone action resultant force is formed on the hair in the direction away from the surface of the roller brush under the action of the two cyclonic grooves 2. Therefore, the hair is blown away in the direction away from the surface of the base body 1, so that a higher cyclone force can be formed at a lower energy consumption of the vacuum cleaner, and the hair is in a state similar to "floating" on the outer surface of the roller brush, thus fundamentally solving the problem that the hair is entangled on the roller brush.

Here, "two first grooves 21 arranged in sequence" means that the two first grooves 21 are arranged in sequence in the circumferential direction of the outer surface of the base body. As a result, an effect similar to that of the two first grooves 21 arranged oppositely can also be produced. The merging effect of air flow is formed, so that the hair is blown out in a direction far away from the base body 1.

In other possible embodiments, the region at the connection position of the two first grooves 21 forms a structural shape that protrudes outward in a direction away from the axial center line a of the roller brush and forms a protruding portion 23. The arrangement relationship between the large-diameter groove walls 211 of the two first grooves 1 and the protruding portion 23 is that the large-diameter groove wall 211 of one first groove 1, the protruding portion 23 and the large-diameter groove wall 211 of the other first groove 1 are respectively arranged in the circumferential direction of the base body 1.

Figure 6:
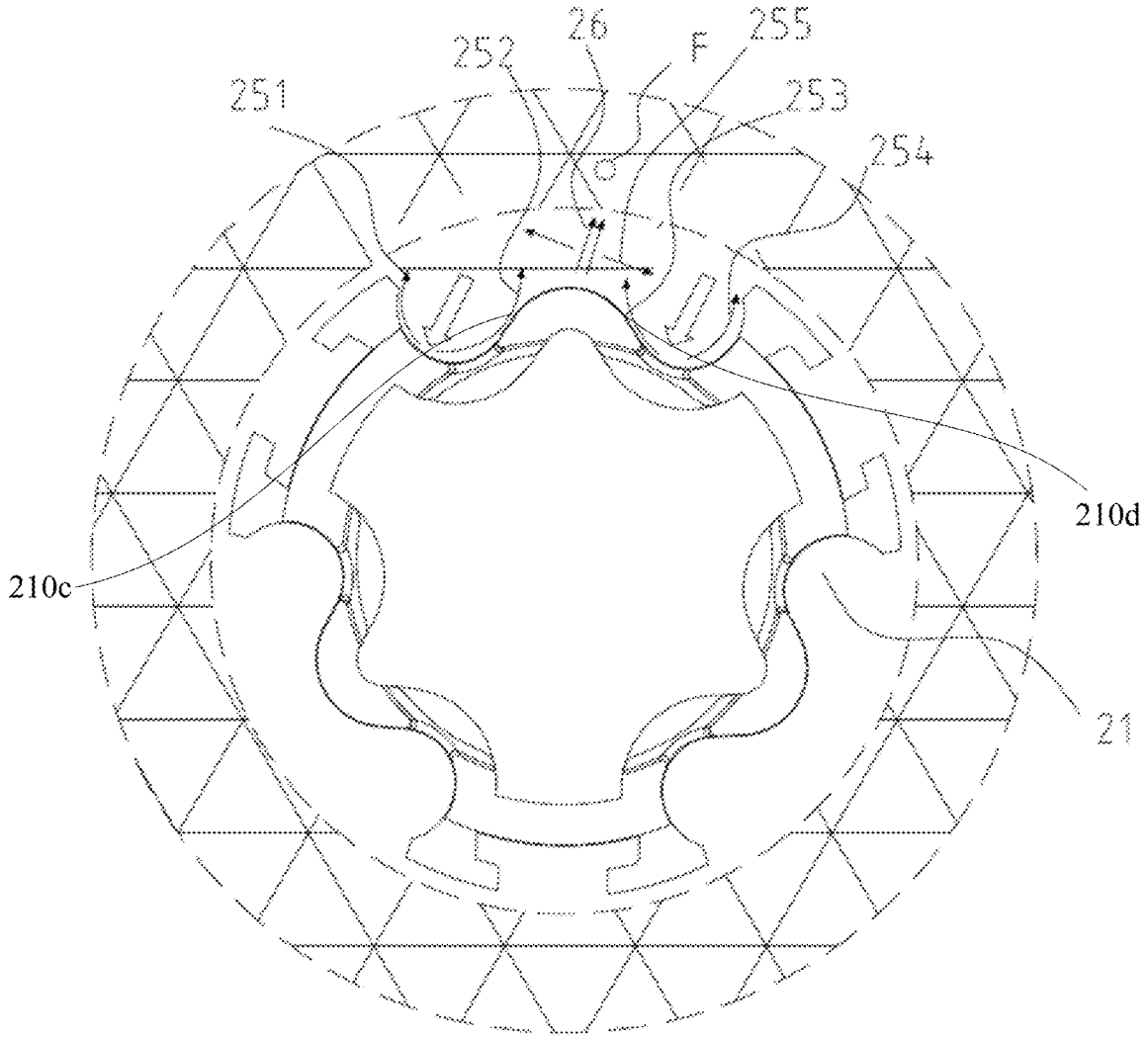
FIG. 6 is a schematic diagram of blowing hair to the region floating on the outer surface of the base body under the guidance of two first grooves.

Here, the rotating guide of the two first grooves 21 makes the hair "float" on the surface of the base body 1, and the effect of merging the air flow through the two first grooves 21 are illustrated schematically. The hollow arrow in FIG. 6 represents that during the rotation of the roller brush, with the suction process of the vacuum cleaner, when the outside air flow enters the suction cavity of the vacuum cleaner and collides with the first grooves 21, the flow direction of the air flow is shown schematically in FIG. 6. The first air flow 251, the second air flow 252, the third air flow 253 and the fourth air flow 254 illustrate the flow directions of the wind guided by the inner side wall of the first groove 21 after the outside air flow enters the first groove 21.

The second air flow 252 and the third air flow 253 merge, and the air flow 255 illustrates two air flows that cancel each other out after being directed through two first grooves 21, respectively, thereby creating a merging effect of the air flow 26. After the air flows formed in the mutually adjacent regions 210*c* and 210*d* of the two first grooves 21 merge to form the air flow 26, the air flow 26 forms a greater force to blow outward away from the outer surface of the base body 1. The wind force after being guided and merged by the two first grooves 21 is greater, so that the hair in the suction cavity is blown to be roughly located at an annular region (i.e., a grid-like annular region in the figure) floating on the outer surface of the base body 1. The example illustrated here is that the two first grooves 21 are uniform in size, in which case the resultant force point after the guiding and merging of the two first grooves 21 is located approximately at point F in the grid-like annular region. Since the two first grooves 21 are uniform in size, the resultant force point F is located approximately in a region between positions outside the two first grooves 21. If the two first grooves 21 are not uniform in size, the resultant force point F is located near the side of the smaller groove 21, but the resultant force point F is still located in the grid-like region in FIG. 6.

In some cases, the merging point passing through the two first grooves 21 is approximately outside the middle region of the two first grooves 21 and is blown away in the direction away from the base body 1; with the rotation of the roller brush, the merging point of the two wind forces guided by the two first grooves 21 may also be located near the side of a certain first groove 21 away from the base body 1. It is only necessary to ensure that the air flow passing through each group of cyclonic grooves 2 is guided to merge so as to blow away the hair or the like in a direction away from the base body 1.

As used herein, "two first grooves 21 arranged in sequence" means that the two first grooves 21 are arranged in sequence on the surface of the roller brush in the circumferential direction of the roller brush.

In some embodiments of the present disclosure, the region of the small-diameter groove wall 212 closest to the axial center line a is used as the base diameter of the base body 1, so that the overall outer diameter of the roller brush is not increased by the arrangement of the groove body 21, and the vacuum cleaner head is prevented from being excessively bulky. That is, the possibility of hair entanglement in the base body 1 of the vacuum cleaner is greatly reduced while keeping the overall appearance and size of the vacuum cleaner as much as possible, so that the problem of hair entanglement of the brush can be fundamentally solved.

In some embodiments of the present disclosure, when the number of first grooves in each group of cyclonic grooves 2 is two, the two first grooves 21 are arranged in mirror images. Here, "mirror-image arrangement" means that the dimensions of the two first grooves 21 are identical and are arranged symmetrically with respect to each other.

In other possible embodiments, as shown in FIG. 5 (*b*), when the number of first grooves in each group of cyclonic grooves 2 is two, the two first grooves 21 are not uniform in size, i.e., the Ds are not equal, i.e., one first groove 21 is a larger groove and the other first groove 21 is a smaller groove, and the two first grooves 21 are not in a completely mirror-symmetrical configuration. The mutually distant inner side walls 210*a* and 210*b* of the two first grooves 21 extend outward toward the direction away from the axial center line of the base body 1.

In other possible embodiments of the present disclosure, the first edge 213 may also be a curved line, a wavy line or a broken line. Thus, accordingly, the first position 214 is located on surfaces of a plurality of different cylinders. Since the first edge 213 is in a non-linear form, the first position 214 is a set of a plurality of point positions along the first edge 213. Obviously, the whole first edge 213 may be a straight line or a curved line, a wavy line or a broken line, or a part of the first edge 213 may be a straight line and a part of the first edge 213 may be at least one of a curved line, a wavy line or a broken line.

In some embodiments of the present disclosure, there are three groups of cyclonic grooves 2, and the three groups of cyclonic grooves 2 are evenly distributed in equal phase on the outer surface of the roller brush. A separation region is arranged between two adjacent groups of cyclonic grooves 2. In a possible embodiment, a soft scraper may be arranged in the separation region, for example, the soft scraper may be a brush, a sponge or a leather strap. By arranging the cyclonic groove 2 so that the hair floats on the outer surface of the soft scraper, the possibility of the hair or the like becoming entangled or embedded in the soft scraper is also greatly reduced and the possibility of the hair or the like becoming entangled on the surface of the roller brush is minimized.

In a possible embodiment, the soft scraper is arranged on the outer surface of the roller brush by means of fixing ribs 25. Obviously, the separation region may be not provided with a soft scraper, i.e., the separation region only plays a role in separating two groups of cyclonic grooves 2 to a certain extent. Therefore, it can be avoided that when the roller brush rotates, there is mutual interference among groups of cyclonic grooves 2, which will form a reaction force to blow hair off the surface of the roller brush.

In other possible embodiments of the present disclosure, there may be less than three groups (e.g., one group or two groups) or more than three groups (e.g., four groups, five groups or more groups) of cyclonic grooves 2.

Figure 7:
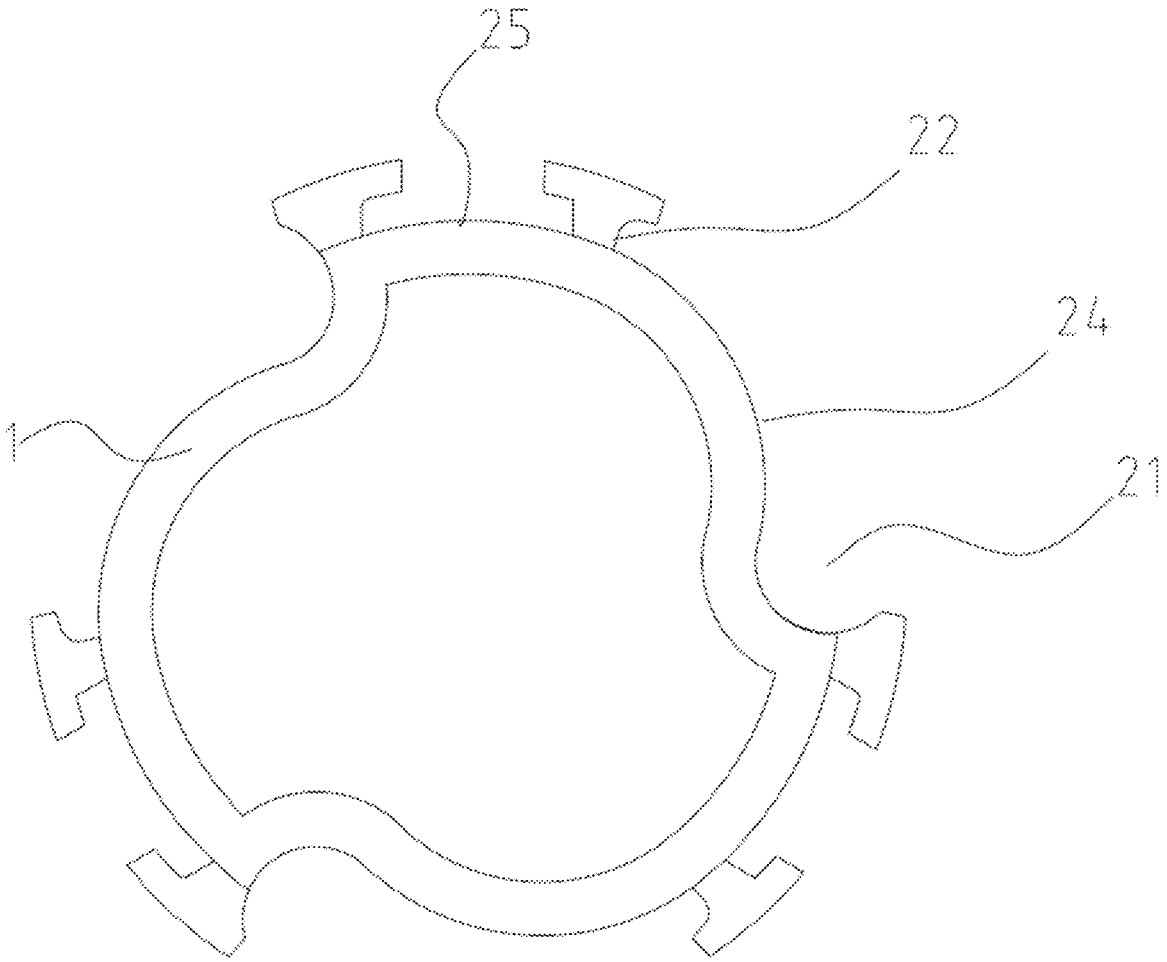
FIG. 7 (*a*) is a schematic side view of a roller brush including one first groove and one second groove.
Figure 7:
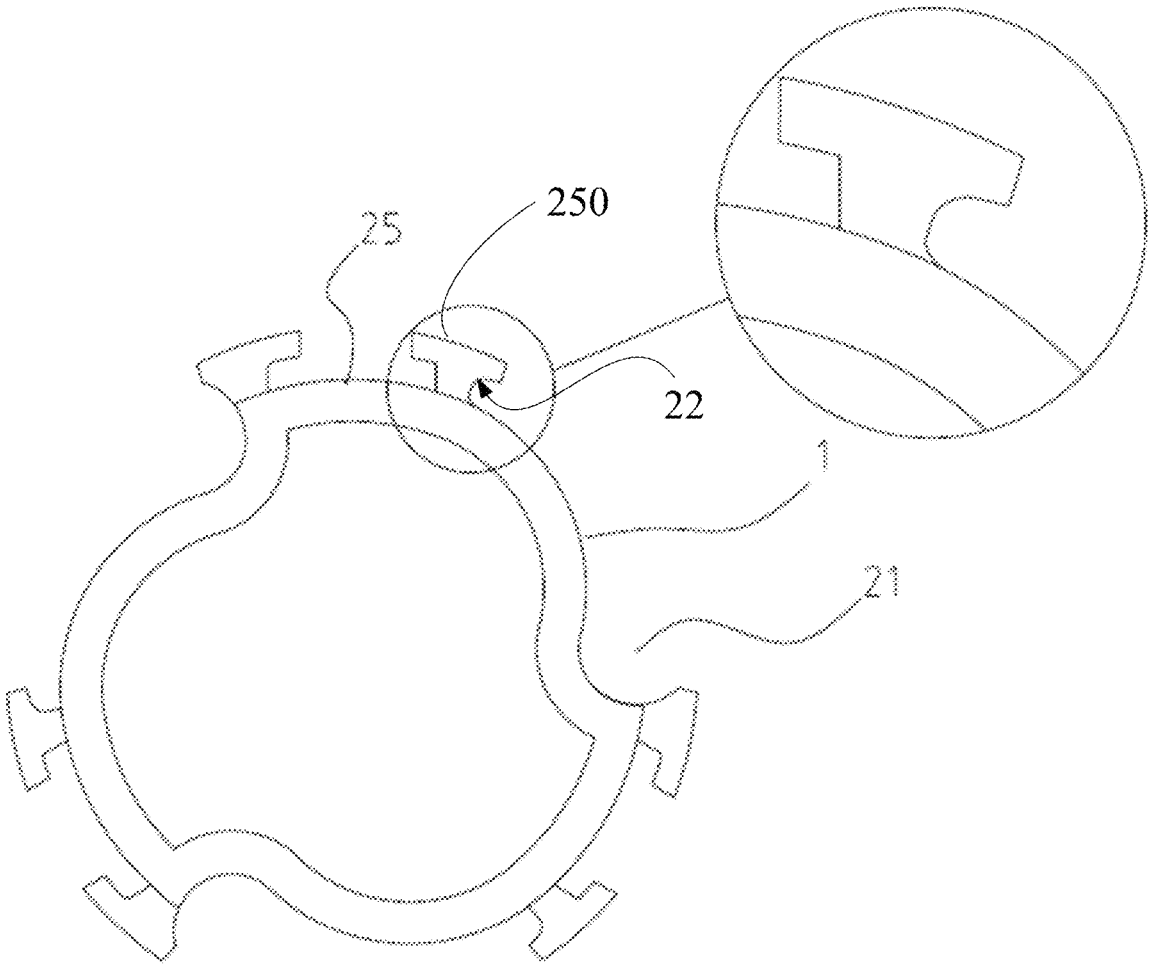

Referring to FIG. 7 (*a*), in some embodiments of the present disclosure, each group of cyclonic grooves 2 includes one first groove 21 and one second groove 22, wherein the second groove 22 has a groove depth of not exceeding 2 mm, and the second groove 22 is opposite to the first groove 21. The "groove depth" of the second groove 22 means the distance from a cylinder surface C where the inner edge on the side of the second groove 22 near the roller brush is located and which takes a as the central axis to a cylinder surface E where the inner groove wall on the side of the second groove 22 near the roller brush is located and which takes a as the central axis, that is, the distance between C and E in the radial direction of the base body 1 does not exceed 2 mm. In the present application, for "the second groove 22 being opposite to the first groove 21", reference is made to the above description of "two first grooves 21 being opposite to each other".

In some embodiments, an intermediate portion 24 is further arranged between the second groove 22 and the first groove 21 connected to the second groove 22 and the first groove 21, and the first groove 21, the intermediate portion 24, and the second groove 22 are arranged in sequence in the circumferential direction of the base body 1.

In some embodiments, the second groove 22 may be formed by directly arranging a shape recessed toward the direction away from the first groove 21 in the same group on the connector 250 (as shown in FIG. 7 (*b*)), and forming a groove bottom on the connector 250, thereby facilitating the processing of the roller brush.

In other possible embodiments, the second groove 22 also forms a groove bottom in a similar design to the first groove 21, i.e., directly forming the groove bottom by recessing the outer side surface of the roller brush toward the center of the roller brush. Thereby, the connection and mounting of the connector 250 to the roller brush is facilitated.

Figure 8:
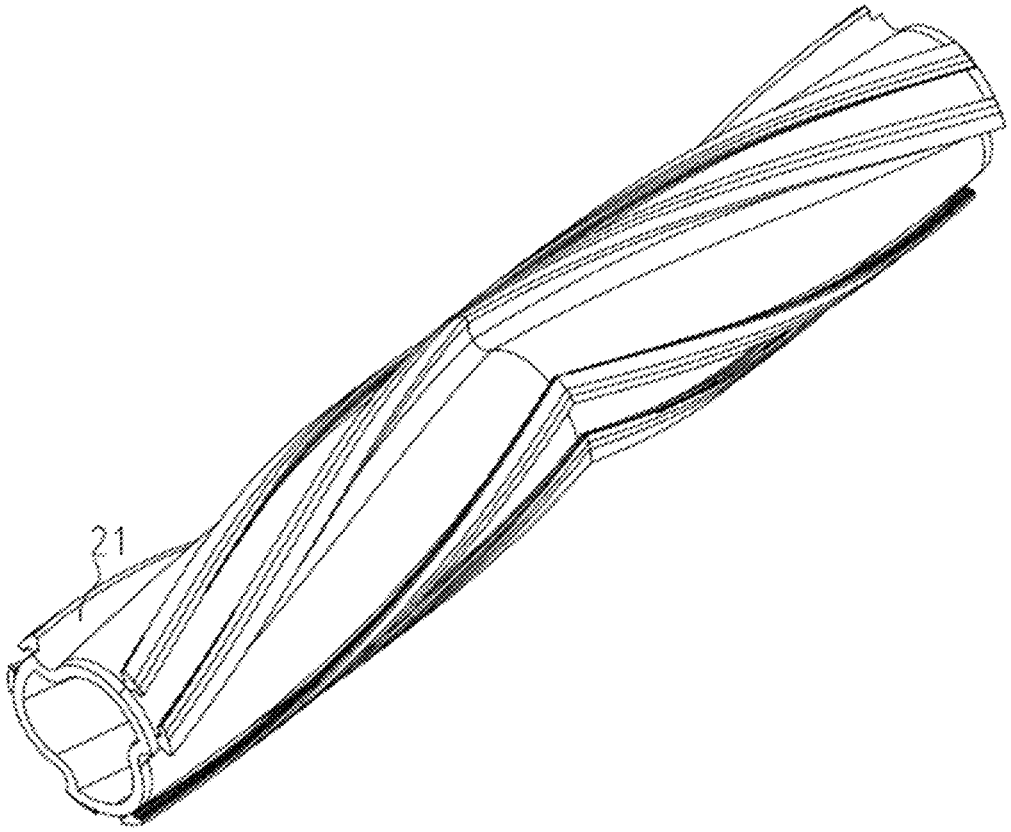
FIG. 8 (*a*) is a three-dimensional structural schematic diagram of one embodiment in which a cyclonic groove in a V-shaped configuration.
Figure 8:
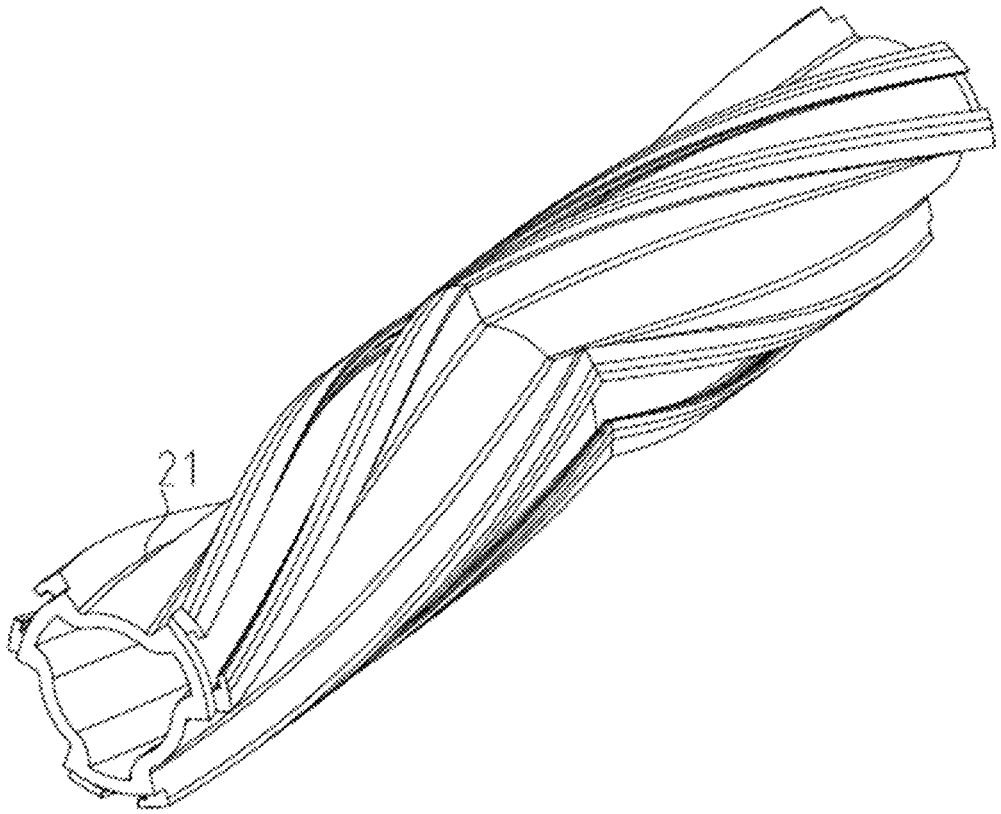

In other possible embodiments, the first groove 21 may also be arranged in a V shape on the outer surface of the roller brush. In the case where the first groove 21 is arranged in a V shape, as shown in FIGS. 8 (*a*) and 8 (*b*), each group of cyclonic grooves 2 may be integrally arranged in a V shape, and a sharp corner region of the V shape may be arranged in an axially intermediate region of the outer surface of the roller brush, and accordingly, the first groove 21 helically (or linearly) extends from the sharp corner region toward two ends of the roller brush. Two ends of the cyclonic groove 2 may extend to two ends of the base body 1 of the roller brush; the two ends of the cyclonic groove 2 may also not be located at the ends of the base body 1.

Figure 9:
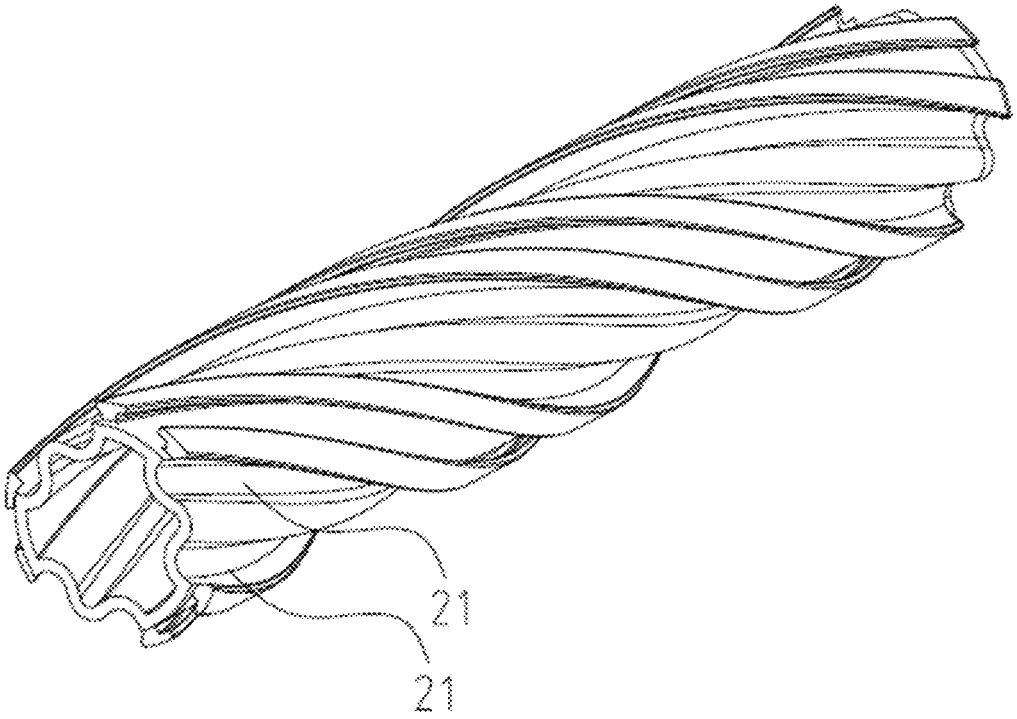
FIG. 9 (*a*) is a three-dimensional structural schematic diagram of one embodiment in which a cyclonic groove in a spiral-shaped configuration.
Figure 9:
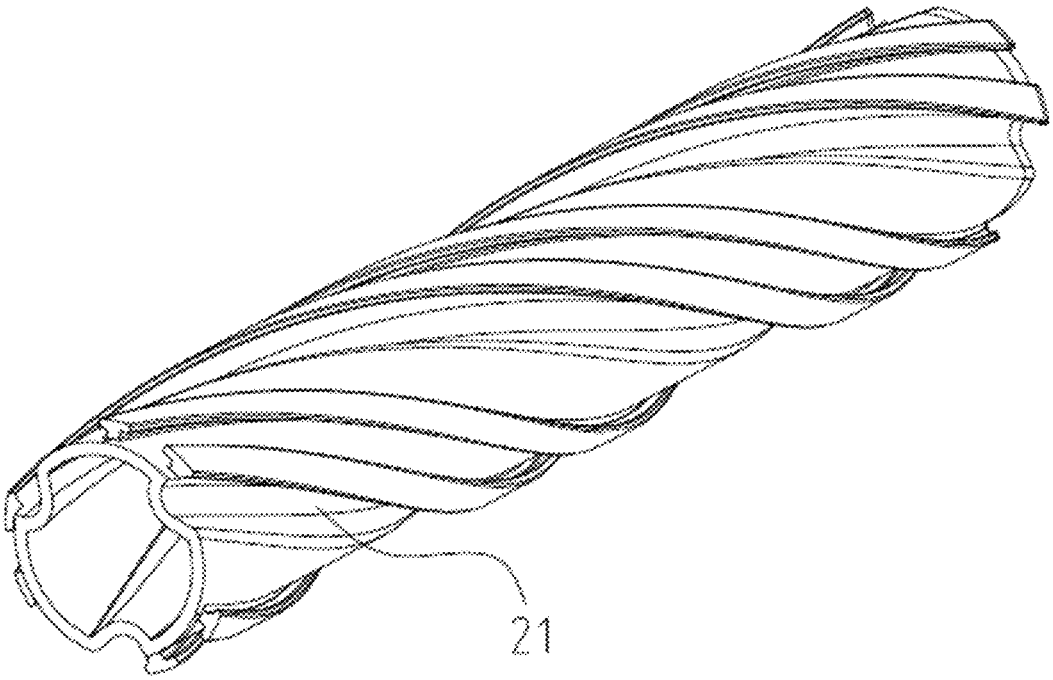

Only the specific embodiment in which the first groove 21 is linear is listed above. Obviously, in other possible embodiments, the first groove 21 may also be spirally arranged on the outer surface of the roller brush (as shown in FIGS. 9(*a*) and 9(*b*)).

Figure 10:
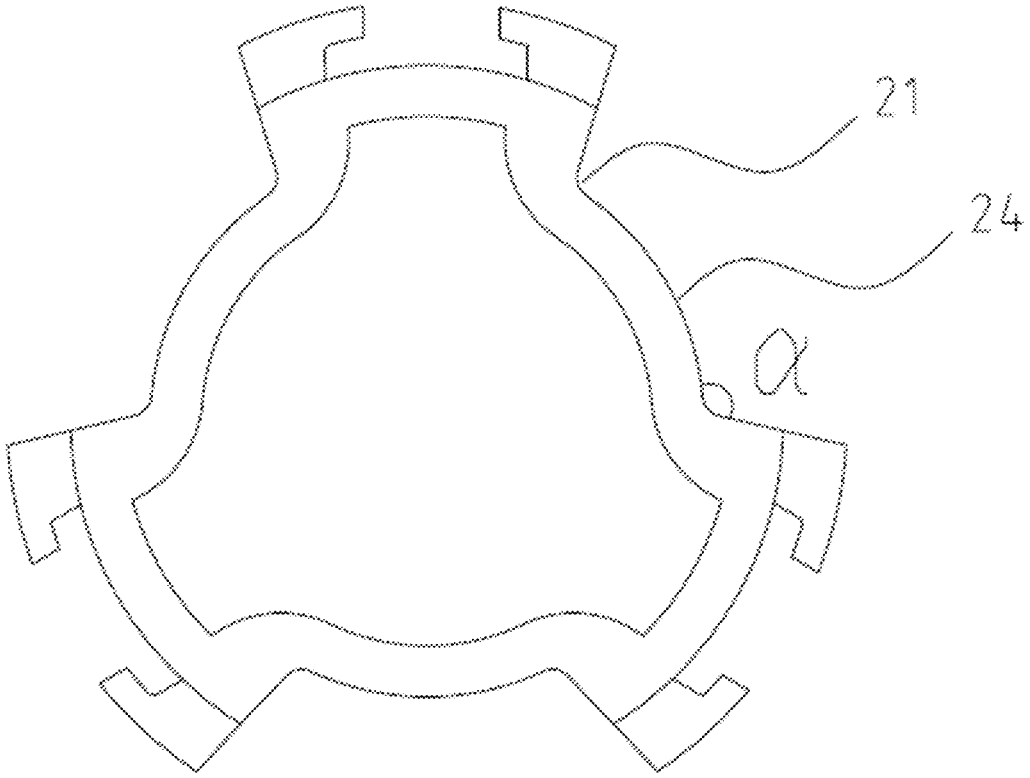
FIG. 10 is a schematic side view of a first groove of the present disclosure having a wide-mouth V shape.

In some embodiments of the present disclosure, the shape of the cross section of at least partial region of the first groove 21 is at least one of U shape, a C shape, a V shape, an arc shape, a semicircle shape, and a right-angle shape. When the first groove 21 is V-shaped, the opening may have an acute or obtuse angle. When the first groove 21 is V-shaped (as shown in FIG. 10), the included angle between the planes where the two groove walls of the first groove 21 are located does not exceed 123 degrees. Within this angle range, the air flow guided by the first groove 21 can blow hair and the like toward the direction away from the surface of the roller brush. For example, when the first groove 21 is V-shaped, the included angle between the planes where the two groove walls of the first groove may be 123 degrees, or 119 degrees, or 116 degrees, or 110 degrees, or 100 degrees, or 95 degrees, or 89 degrees, or 85 degrees, or any other angle not exceeding 123 degrees.

In some embodiments of the present disclosure, the groups of cyclonic grooves 2 on the same roller brush may have the same or different shapes. For example, when one cyclonic groove 2 is V-shaped, the cyclonic groove 2 adjacent thereto may be C-shaped or U-shaped, or other shapes. In the case where the number of first grooves in each group of cyclonic grooves 2 is two, the two first grooves 21 in each group of cyclonic grooves 2 may also be in different shapes.

In some embodiments of the present disclosure, the shape of the cross section of the second groove 22 is at least one of U shape, a C shape, a V shape (which may be narrow-mouth V shape or wide-mouth V shape as shown in FIG. 10), an arc shape, an L shape, a semicircle shape and a right-angle shape, and when the second groove 22 is V-shaped, the opening angle of the second groove 22 does not exceed 123 degrees.

In the embodiment shown in FIG. 10, the surfaces on the sides of the two first grooves 21 away from each other are no longer curved, but inclined in a direction away from each other.

In some embodiments, the intermediate portion 24 at the intermediate region of the two first grooves 21 is formed by the surface of the original outer contour of the base body 1 (cylindrical surface). Thus, the original structure of the base body 1 of the roller brush is exploited, and the processing is convenient.

In addition, the present disclosure makes use of the smaller inner ring structure of the base body 1 as the region of the intermediate portion 24 of the first groove 21, so that it is not necessary to increase the external size of the roller brush due to the arrangement of the cyclonic groove 2 having a larger size. For example, if it is intended to set the overall external sizes of the base body 1 of the roller brush to 50 mm or so, if the cyclonic groove still needs to be arranged on the structure with the outer diameter of 50 mm, the maximum diameter of the base body 1 of the roller brush may reach 60 mm or even larger in order to arrange the groove wall structure of the cyclonic groove, which does not allow any matching with the existing vacuum cleaner structure and makes the vacuum cleaner head more bulky and not easy to handle.

In some embodiments, the second position 215 may be in the form of a smooth surface such as a smooth curved surface, a ramp surface, or a groove surface. Thereby, the machining of the roller brush is facilitated.

Figure 11:
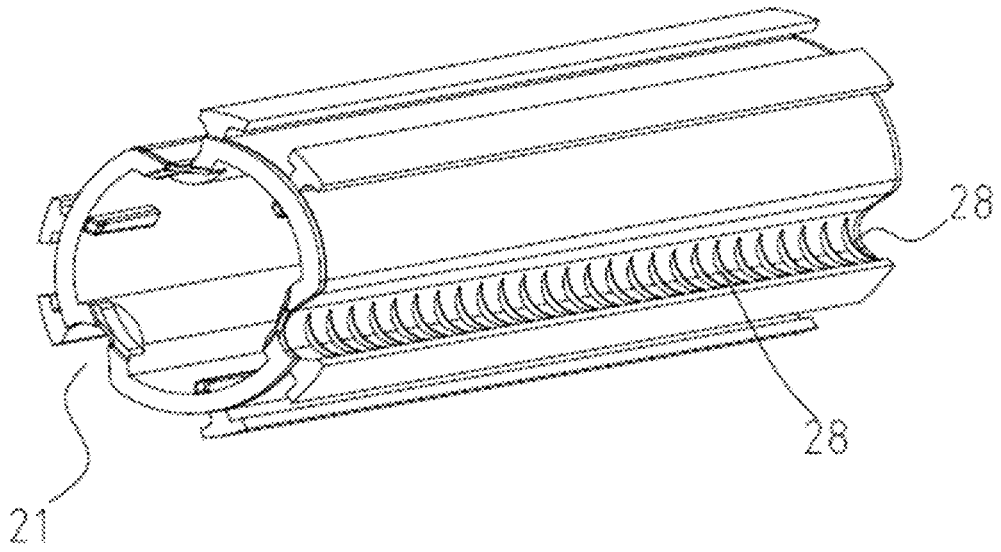
FIG. 11 is a schematic diagram of a sheet structure of a second position according to an embodiment of the present disclosure.

In other possible embodiments, the second position 215 may be a serrated surface or be of a structure have a plurality of spaced sheet structures, micro-grooves or cavities or pits. As shown in FIG. 11, taking the second position 215 being provided with a plurality of sheet-like structures 28 as an example, the sheet-like structures 28 are arranged in sequence in the length direction of the second position 215, and the sheet-like structure 28 may be arranged in the direction perpendicular to the axial center line a or inclined at a certain angle, and the sheet-like structures 28 can play a role in guiding wind.

In some embodiments of the present disclosure, as shown in FIG. 2 (*b*), the second groove 22 may not be provided, and a ramp surface 27 may be arranged corresponding to the second groove 22, the edge on the side of the ramp surface 27 adjacent to the base body 1 extends toward the side near the first groove 21 which belong to the same group as the ramp surface. Thus, under the guided swirling of one first groove 21, it is also possible to blow hair or the like to a region close to the surface of the base body 1.

The present disclosure also provides a floor brush of a vacuum cleaner, including the aforementioned roller brush.

The present disclosure also provides a vacuum cleaner, including the floor brush of a vacuum cleaner as previously described.

The above embodiments are merely illustrative of the technical concepts and features of the present disclosure, and are intended to enable those skilled in the art to understand and practice the present disclosure, and should not be construed as limiting the scope of the present disclosure. Equivalent variations and modifications made according to the spirit of the present disclosure are intended to be included within the scope of the present disclosure.

What is claimed is:

1. A roller brush, comprising a base body, wherein an axial center line of the base body is a, an outer surface of the base body is provided with at least one group of cyclonic grooves, and each group of cyclonic grooves comprises:

at least one first groove, wherein a first inner groove wall on a side of the first groove away from the axial center line a has a first diameter, and a second inner groove wall on a side of the first groove close to the axial center line a has a second diameter smaller than the first diameter, an edge of the first groove wall away from a is a first edge, and at least partial region of the first edge overlaps with a surface of at least one cylinder taking a as an axial center line, with an overlapping region being a first position; at least partial region of the second groove wall in a length direction of an overlaps with a surface of a cylinder taking a as an axial center line, with an overlapping region being a second position;

the surface of the cylinder passing through the first position and taking a as the axial center line is taken as A, and the surface of the cylinder passing through the second position and taking a as the axial center line is taken as B, and a distance D between the A and the B in a radial direction of the base body is greater than 2 mm.

2. The roller brush according to claim 1, wherein at least partial region of the first edge is a straight line, and at least partial region of the first position is a straight line.

3. The roller brush according to claim 1, wherein at least partial region of the first edge is a straight line, a curved line, a wavy line or a broken line.

4. The roller brush according to claim 1, wherein each group of cyclonic grooves comprises two first grooves arranged in sequence in a circumferential direction of the base body, and the two first grooves are oppositely or sequentially arranged on a surface of the base body.

5. The roller brush according to claim 4, wherein the two first grooves in each group of cyclonic grooves are arranged in mirror images.

6. The roller brush according to claim 5, wherein mutually adjacent regions of the two first grooves protrude toward a direction away from the axial center of the roller brush.

7. The roller brush according to claim 4, wherein the two first grooves are not uniform in size, and the Ds are not equal.

8. The roller brush according to claim 1, wherein mutually distant inner side walls of the two first grooves extend toward the direction away from the axial center line of the base body.

9. The roller brush according to claim 1, wherein each group of cyclonic grooves comprises one first groove, and further comprises one second groove, wherein the second groove has a groove depth of not exceeding 2 mm, and the second groove is opposite to the first groove.

10. The roller brush according to claim 9, wherein the second groove is arranged on the outer surface of the base body.

11. The roller brush according to claim 9, further comprising a connector connected to the outer surface of the base body, wherein the second groove is arranged on the connector.

12. The roller brush according to claim 1, wherein a shape of a cross section of at least partial region of the first groove is at least one of a U shape, a C shape, a V shape, an arc shape, an L shape, a semicircle shape, and a right-angle shape, and when the first groove is V-shaped, an opening angle $\alpha$ of the first groove does not exceed 123 degrees.

13. The roller brush according to claim 9, wherein a shape of a cross section of the second groove is at least one of a U shape, a C shape, a V shape, an arc shape, a semicircle shape, and a right-angle shape, and when the second groove is V-shaped, an opening angle $\alpha$ of the second groove does not exceed 123 degrees.

14. The roller brush according to claim 1, wherein the first groove is arranged on the outer surface of the base body in a spiral shape, a V shape or a straight line shape.

15. The roller brush according to claim 14, wherein when the first groove is arranged in a straight line, the first groove is arranged in a direction parallel to or at a spaced angle to the axial center line of the base body.

16. The roller brush according to claim 9, wherein mutually distant inner side walls of the first groove and the second groove extend toward the direction away from the axial center line of the base body.

17. A floor brush of a vacuum cleaner, comprising the roller brush according to claim 1.

18. A floor brush of a vacuum cleaner, comprising the roller brush according to claim 13.

19. A vacuum cleaner, comprising the floor brush of a vacuum cleaner according to claim 17.

20. A vacuum cleaner, comprising the floor brush of a vacuum cleaner according to claim 18.

* * * * *